US010482851B2

(12) United States Patent
Kuno et al.

(10) Patent No.: US 10,482,851 B2
(45) Date of Patent: Nov. 19, 2019

(54) KEY UNIT AND KEYBOARD INSTRUMENT

(71) Applicant: CASIO COMPUTER CO., LTD., Shibuya-ku, Tokyo (JP)

(72) Inventors: Toshiya Kuno, Hamura (JP); Hirokazu Taniguchi, Tachikawa (JP); Yuichi Nishimura, Saitama (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/136,214

(22) Filed: Sep. 19, 2018

(65) Prior Publication Data

US 2019/0096370 A1 Mar. 28, 2019

(30) Foreign Application Priority Data

Sep. 27, 2017 (JP) ..... 2017-185998

(51) Int. Cl.

| | |
|---|---|
| ***G10C 3/12*** | (2006.01) |
| ***G10H 1/34*** | (2006.01) |
| ***G10C 3/02*** | (2006.01) |

(52) U.S. Cl.

CPC ..... *G10C 3/12* (2013.01); *G10C 3/02* (2013.01); *G10H 1/34* (2013.01); *G10H 1/344* (2013.01)

(58) Field of Classification Search

CPC ..... G10C 3/12; G10C 3/02; G10H 1/34

See application file for complete search history.

(56) References Cited

U.S. PATENT DOCUMENTS 6,002,078 A * 12/1999 Yoshinaga ..... G10H 1/344 84/423 R

FOREIGN PATENT DOCUMENTS

| | | | |
|---|---|---|---|
| JP | 64091187 | A | 4/1989 |
| JP | 01170990 | A | 7/1989 |
| JP | 06318076 | A | 11/1994 |
| JP | 2007256751 | A | 10/2007 |
| JP | 2016170288 | A | 9/2016 |

* cited by examiner

*Primary Examiner* — Kimberly R Lockett

(74) *Attorney, Agent, or Firm* — Holtz, Holtz & Volek PC

(57) ABSTRACT

A keyboard instrument includes a plurality of key blocks, and an instrument case. Each key block includes, a plurality of key main bodies, an area of the top surface abutting one edge side of the key main body in a longitudinal direction is pressed by a user; a plurality of connecting sections, the connecting section is deformed in response to be pressed by the user; and a supporting section which supports the plurality of key main bodies as one key block through the plurality of connecting sections. The plurality of supporting sections included in the plurality of key blocks are piled up in a direction intersecting with the longitudinal direction in the instrument case. The plurality of connecting sections included in one key block and the plurality of connecting sections included in another key block are overlapped each other in the instrument case.

7 Claims, 5 Drawing Sheets

KEY UNIT AND KEYBOARD INSTRUMENT

CROSS-REFERENCE TO RELATED APPLICATIONS

This application is based upon and claims the benefit of priority from the prior Japanese Patent Application No. 2017-185998, filed on Sep. 27, 2017, the entire contents of which are incorporated herein by reference.

BACKGROUND OF THE INVENTION

1. Field of the Invention

The present invention relates to a key unit and a keyboard instrument.

2. Description of the Related Art

Conventionally, a plurality of keys are connected to a supporting section through a connecting section in a swingable state to form a key block. A plurality of such key blocks are overlapped as one to form a key unit (for example, see Japanese Patent Application Laid-Open Publication No. 2016-170288).

As described above, when the plurality of keys are in a set as a key unit and fixed to a keyboard chassis to be used as a keyboard, the efficiency of assembly is enhanced comparing to combining the plurality of keys separately.

The connecting section which connects the key to the supporting section is formed to be able to bend and deform. When the key is pressed, the connecting section changes position along the direction that the key is pressed so that the key rotates.

According to the conventional configuration, the connecting section is provided on a lower side of the key in a thickness direction.

In such keyboard instrument, a guide is provided to guide the key to the keyboard chassis side where the key is attached so as to suppress rattling in a horizontal direction. When the key is pressed, the key is guided by the guiding section.

However, as in the conventional configuration, when the connecting section is provided on the lower side of the key in the thickness direction, both the guiding section of the keyboard chassis and the connecting section support the key at a low position on the lower side of the key.

Therefore, the key is not stable in the horizontal direction and the rattling is not sufficiently suppressed.

According to the present invention, a connecting section 32 which is able to bend and deform allows preferable operation when the key is pressed in a keyboard instrument 100 including a key unit 1 in which a supporting section 11 is connected with a plurality of keys 3.

SUMMARY OF THE INVENTION

According to an aspect of the present invention, there is a keyboard instrument including: a plurality of key blocks, each key block including, a plurality of key main bodies, each key main body has a top surface, an area of the top surface abutting one edge side of the key main body in a longitudinal direction is pressed by a user; a plurality of connecting sections, respectively corresponding to the plurality of key main bodies, each connecting section is provided in the top surface side abutting the other edge side of the key main body in the longitudinal direction, the connecting section is deformed in response to be pressed by the user; and a supporting section which supports the plurality of key main bodies as one key block through the plurality of connecting sections; and an instrument case which houses the plurality of key blocks, wherein the plurality of supporting sections included in the plurality of key blocks are piled up in a direction intersecting with the longitudinal direction in the instrument case, and the plurality of connecting sections included in one key block and the plurality of connecting sections included in another key block are overlapped each other in the instrument case.

BRIEF DESCRIPTION OF THE DRAWINGS

The present invention will be more understood with reference to the following detailed descriptions with the accompanying drawings.

DETAILED DESCRIPTION OF THE PREFERRED EMBODIMENTS

With reference to FIG. 1 to FIG. 8A and FIG. 8B, an embodiment of a key unit and a keyboard instrument provided with such key unit according to the present invention is described.

According to the present embodiment, the keyboard instrument 100 is an electronic keyboard instrument such as an electronic piano or keyboard.

Although various limitations technically preferable according to the present invention are described in the embodiments below, the scope of the present invention is not limited by the embodiments and the illustrations described below.

Figure 1:
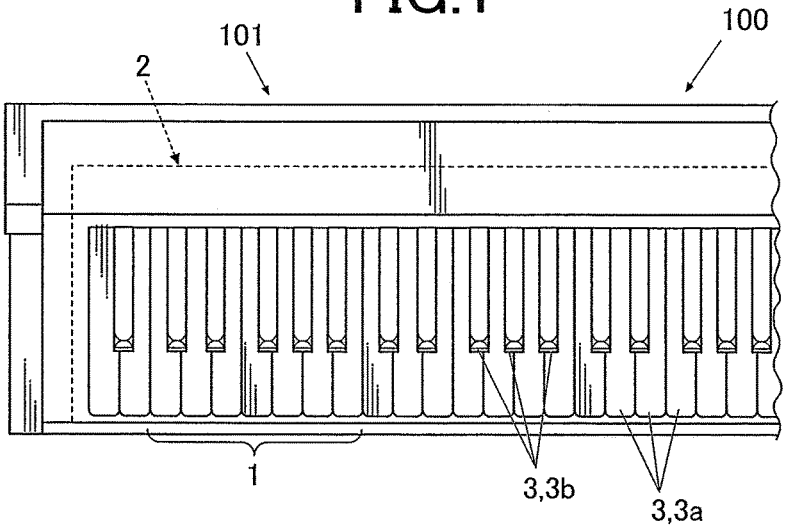
FIG. 1 is a diagram showing a top view of an exterior appearance of a keyboard instrument according to the present embodiment.

FIG. 1 is a diagram showing a top view of the keyboard instrument according to the present embodiment.

As shown in FIG. 1, the keyboard instrument 100 includes a key unit 1 and a keyboard chassis 2 with the key unit 1 attached.

The key unit 1 may be, for example, one set of keys 3 including keys for one octave. A plurality of key units 1 are attached to the keyboard chassis 2 to form the keyboard of the keyboard instrument 100.

The number of keys 3 provided in one unit of the key unit 1 is not limited to the illustrated examples and may be suitably determined.

According to the present embodiment, the key unit 1 and the keyboard chassis 2 are stored inside an instrument case 101.

A substrate (not shown) to control the operation of emitting sound from the keyboard instrument 100 and a speaker are stored inside the instrument case 101.

Although illustration is omitted, an operating switch section (not shown) including a plurality of switches to select and specify various functions such as volume and tone of the keyboard instrument 100 is provided on the upper surface of the instrument case 101.

Figure 2:
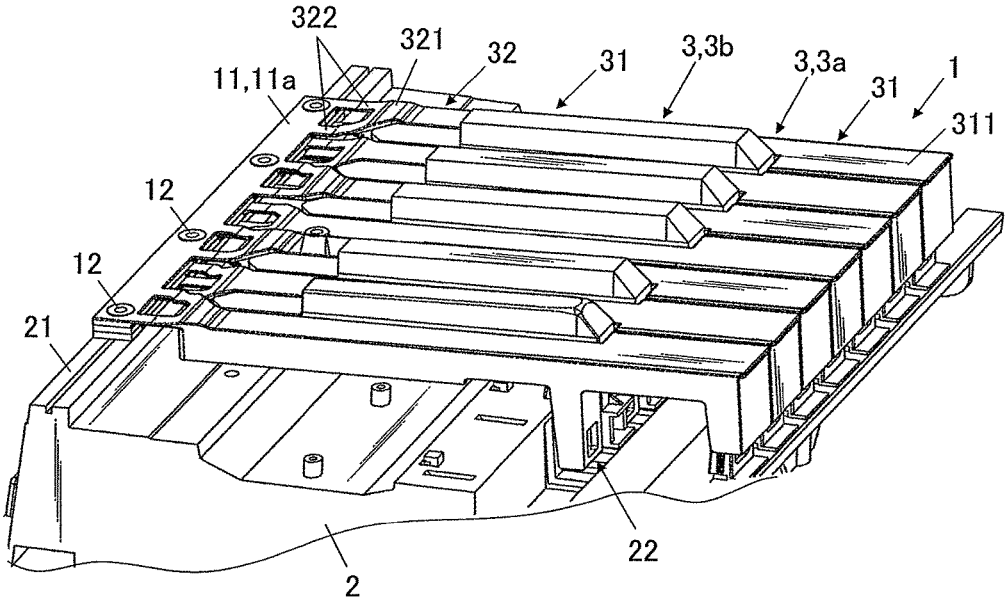
FIG. 2 is a diagram showing a perspective view of a main section showing a portion of an internal configuration of a keyboard instrument.
Figure 3:
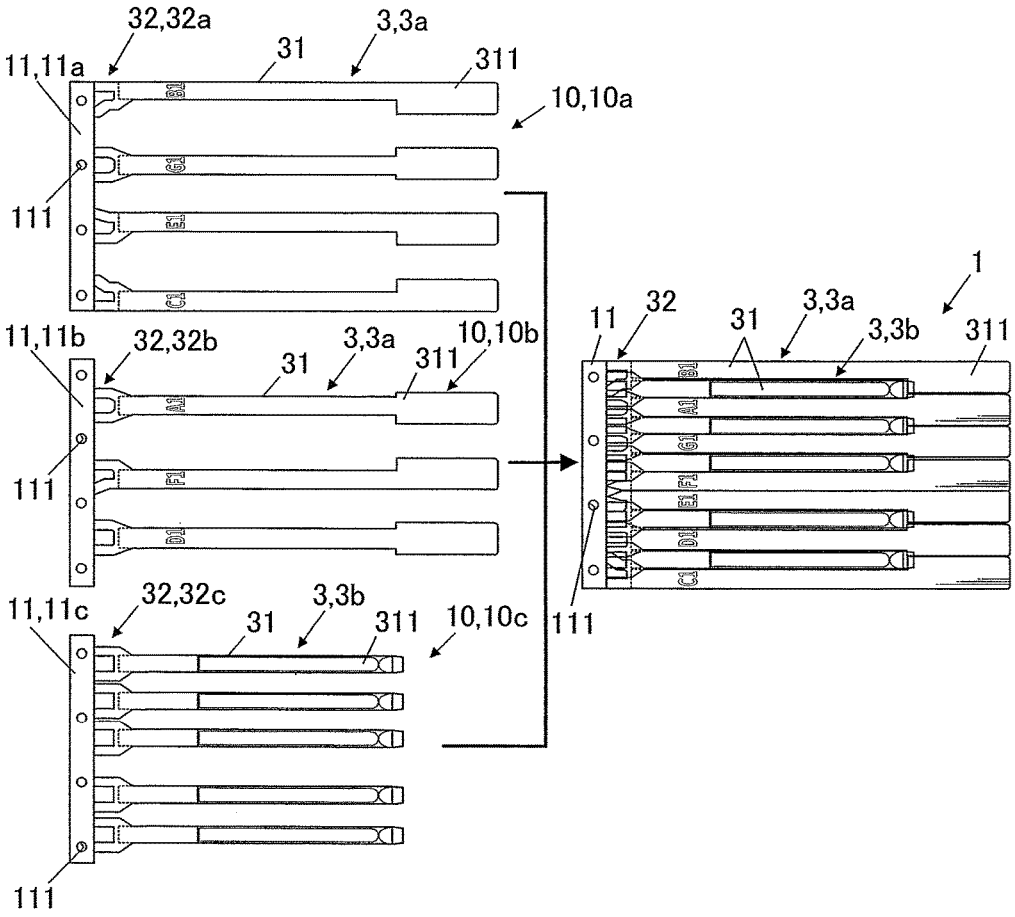
FIG. 3 is a diagram showing a planar view of a key unit and the key unit divided into individual key blocks according to the present embodiment.

FIG. 2 is a diagram showing a perspective view of a main section showing a portion of an internal configuration of the keyboard instrument. FIG. 3 is a diagram of a planar view showing a state in which the key unit is divided into each key block and a state in which the above are assembled. The diagram on the right of FIG. 3 is a transparent view and shows hidden lines which do not actually appear on the outer appearance as solid lines.

Figure 4A:
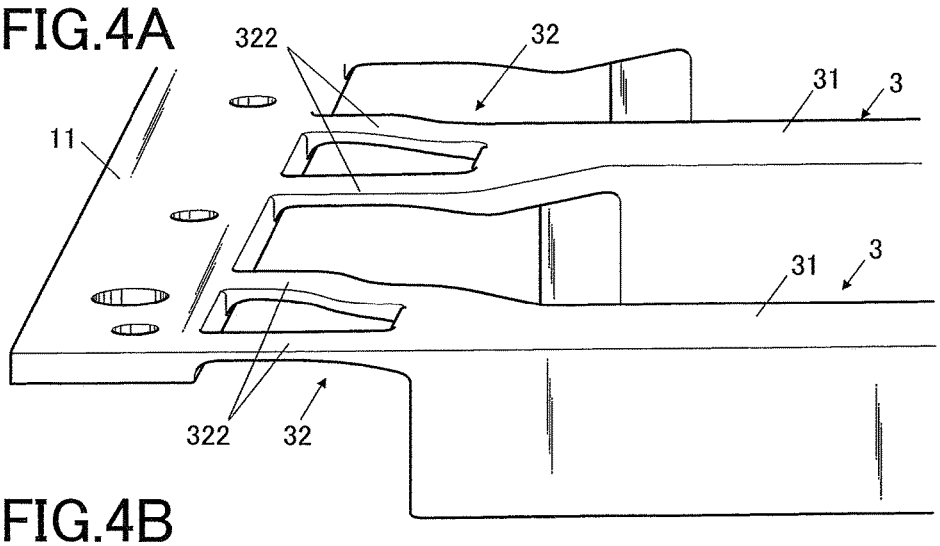
FIG. 4A is a diagram showing a perspective view of the main section enlarging surroundings of a connecting section when a projection is not provided in the connecting section.
Figure 4B:
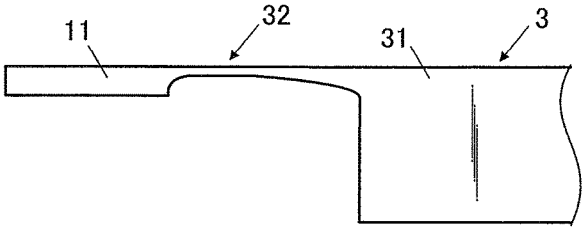
FIG. 4B is a diagram showing a side view of the key block shown in FIG. 4A.

FIG. 4A is a diagram showing a perspective view enlarging a main section of the surroundings of the connecting section of the key block according to one aspect of the present embodiment. FIG. 4B is a diagram showing a side view of a key block shown in FIG. 4A.

Figure 5A:
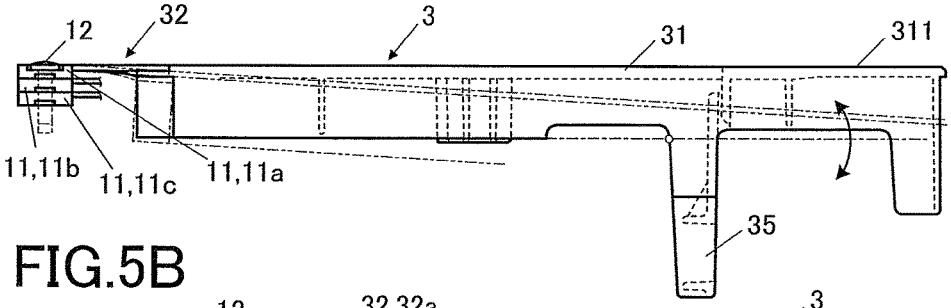
FIG. 5A is a diagram showing a side view of a motion of the key when the key is pressed when the projection is not provided in the connecting section.
Figure 5B:
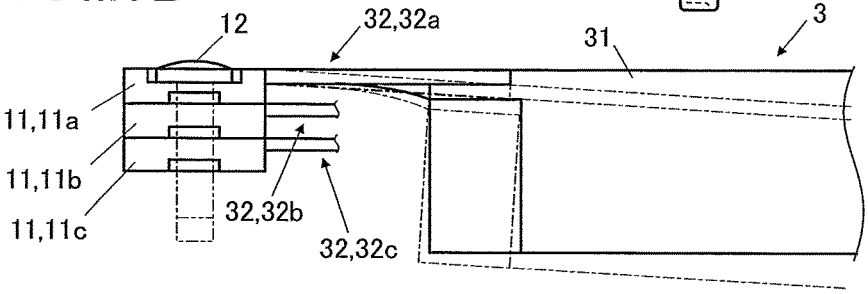
FIG. 5B is a diagram showing an enlarged side view of the surroundings of the connecting section of the key shown in FIG. 5A.

FIG. 5A is a diagram showing a side view of a change in position of the key when the key is pressed. FIG. 5B is a diagram showing a side view of a main section enlarging the surroundings of the connecting section in FIG. 5A.

As shown in FIG. 2, a unit attaching section 21 to which the key unit 1 is attached is provided in a far side (back surface side, left side in FIG. 2) in the keyboard instrument 100 of the keyboard chassis 2. According to the present embodiment, the supporting section 11 of the key unit 1 is fixed to the unit attaching section 21 with a screw 12.

FIG. 2 illustrates one key unit 1 attached to the unit attaching section 21 of the keyboard chassis 2.

On the lower side surface of the near side (right side in FIG. 2) of the keyboard instrument 100 in the keyboard chassis 2, a key guide section 22 is provided standing to guide vertical movement when a key main body unit 31 swings according to each key 3 included in the key unit 1. According to the present embodiment, the key guide section 22 is received in a later-described guide receiving section 35 (see FIG. 5A) and guides the vertical movement of the key main body section 31.

According to the present embodiment, as shown in FIG. 3, the key unit 1 includes three key blocks 10 (10*a*, 10*b*, 10*c*).

Each key block 10 includes a plurality of keys 3 each including the key main body section 31 and connecting section 32, and a supporting section 11 with which the key main body section 31 of the plurality of keys 3 is supported through the connecting section 32.

The supporting section 11 supports the plurality of key main body sections 31 through the connecting section 32 formed as one. Each key block 10 is overlapped on each other with the supporting section 11 and formed as one by being fixed with screws. With this, the key unit 1 is formed.

According to the present embodiment, the key block 10*a* is a block including white key 3*a* among the keys 3. In the key block 10*a*, "B1 key", "G1 key", "E1 key", and "C1 key" on the keyboard are provided substantially aligned adjacent to each other with a space of about one key in between.

The key block 10*b* is a block including the white key 3*a* among the keys 3. In the key block 10*b*, "A1 key", "F1 key", and "D1 key" on the keyboard are provided substantially aligned adjacent to each other with a space of about one key in between.

The key block 10*c* is a block including a black key 3*b* among the keys 3. Similar to the key block 10*a* and the key block 10*b*, each key is provided substantially aligned adjacent to each other with a space of about one key in between.

All of the key blocks 10 (10*a*, 10*b*, 10*c*) are a member formed as one by resin, etc. including the key main body section 31, the connecting section 32, and the supporting section 11.

According to the present embodiment, the plurality of key blocks 10 are positioned so that the supporting sections 11 in each key block 10 are overlapped in a thickness direction which is the direction that the key main body section 31 is pressed and released in a state in which the positions where the plurality of key main body sections 31 are supported at the supporting section 11 in the key block 10 are shifted from each other.

As shown in FIG. 2 to FIG. 4, the key main body section 31 of each key 3 (3*a*, 3*b*) has a top surface which is substantially a plane surface, and includes an action section 311 which is pressed and released, provided on one end side of the key main body 31 in the longitudinal direction. The action section 311 is the portion pressed by the user (performer).

As shown in FIG. 5, the guide receiving section 35 which receives the key guide section 22 is provided in the position corresponding to the key guide section 22 of the keyboard chassis 2 on the rear surface side toward the tip of the key main body section 31. The guide receiving section 35 receives the key guide section 22 and the key main body section 31 is guided along a pressing/releasing direction (that is, vertical direction) of the key 3.

The connecting section 32 is provided in the other end side in the longitudinal direction of the key main body section 31 of each key 3 (that is, the end opposite of the side where the action section 311 is provided).

The size of the connecting section 32 in the thickness direction is formed smaller than the size of the key main body section 31 in the thickness direction. Specifically, the connecting section 32 is a planar portion formed thinner than the key main body section 31, and is a hinge shaped portion which can bend and deform along the pressing/releasing direction of the key main body section 31.

The connecting section 32 of at least one key block 10 among the plurality of key blocks 10 is provided higher than the lowest portion of the key main body section 31 in the thickness direction.

As shown in FIG. 4B, according to the present embodiment, the size of the connecting unit 32 in the thickness direction on the side of the key main body section 31 is formed smaller than the size of the key main body section 31 in the thickness direction on the side of the connecting section 32, and the connecting section 32 of at least one of the key blocks 10 among the plurality of key blocks 10 is provided toward the top surface side than the center in the thickness direction of the key main body section 31.

According to the present embodiment, all of the connecting sections 32 provided in all of the key blocks 10*a* to 10*c* are provided toward the top surface side of the key main body section 31.

As described above, by providing the connecting section 32 on the top surface side of the key main body section 31, the rattling of the key 3 when the key 3 is pressed can be prevented compared to when the connecting section 32 is provided on the bottom surface side of the key main body section 31.

That is, as described above, the key guide section 22 which guides the key is provided on the upper surface of the keyboard chassis, and the key guide section 22 supports the key 3 from the lower side. In this case, if the connecting section 32 positioned on the base side (attaching side) of the key 3 is positioned below the key main body section 31, the support is in the low position in both the front and back in the longitudinal direction of the key 3, and the tip of the key main body section 31 is in a state floating on the key guide section 22. Therefore, this makes the key 3 unstable, and rattling in the width direction easily occurs.

When the connecting section 32 is provided on the top surface side of the key main body section 31, the key 3 is supported by the connecting section 32 positioned on the upper side of the key 3 and the key guide section 22 positioned on the lower side. Therefore, the axis line rises in a small amount and becomes diagonal. Therefore, the rattling can be slightly reduced.

According to the present embodiment, the side of the connecting section 32 connecting to the supporting section 11 is to be a wide section 322, and the size of the connecting section 32 in the width direction is formed larger than the size of the key main body section 31 in the width direction.

Specifically, as shown in FIG. 2 to FIG. 4, the wide section 322 in the connecting section 32 of the present embodiment is divided into two directions on the side connected to the supporting section 11, and is connected with the supporting section 11 in a wide range. Specifically, as shown in FIG. 3, the connecting section 32 according to the present embodiment include a plurality of patterns, and each of the plurality of patterns includes corresponding plurality of key blocks. Specifically, the connecting section 32*a* is a first white key block with a first pattern in which all four of the connecting sections 32 have different shapes. The connecting section 32*b* is a second white key block with a second pattern in which all three of the connecting sections 32 have different shapes. The connecting section 32*c* is a black key block with a third pattern in which all five of the connecting sections 32 have substantially the same shape. According to the present embodiment, as shown in FIG. 6B, the second white key block is overlapped on the upper side of the black key block, and the first white key block is overlapped on the upper side of the above.

The size of the connecting section 32 is made large in the width direction, and with this, it is possible to prevent the key 3 from twisting and distorting in the width direction when the key is pressed and the key can be pressed suitably. With this, it is possible to prevent providing a strange feeling to the performer (user).

According to the present embodiment, the shape of the wide section 322 is divided into two directions, but the shape and the configuration of the wide section 322 is not limited to the illustrated example. For example, the wide section 322 can be divided into three or more directions, or can be a simple wide section without dividing into two directions. As described below, in order to prevent as much as possible the influence of the pressing on the key 3 of the key block 10 on the upper side applied on the key block 10 on the lower side when the plurality of key blocks 10 are overlapped in the thickness direction, preferably, the wide section 322 has the shape divided into two directions and has a sufficient width but is also provided with a space as much as possible.

The connecting section 32 according to the present embodiment is formed so that the thickness on the side of the supporting section 11 is thicker than the thickness on the side of the key main body section 31.

When the key is pressed, the connecting section 32 bends and the tip (side on which the action section is provided) of the key 3 rotates downward. For example, when the thickness of the connecting section 32 on the side of the supporting section 11 and the thickness of the connecting section 32 on the side of the key main body section 31 are the same, the connecting section 32 may bend and deform at the side closer to the side of the supporting section 11 or at the side closer to the side of the key main body section 31, and the position where the connecting section 32 bends and deforms is not stable. That is, the position of the rotating center (virtual rotating center) of the key main body section 31 in the depth direction in response to pressing each of the plurality of key main body sections 31 may differ and the feeling felt when pressing the key 3 may be different depending on the key 3.

When the connecting section 32 bends and deforms in the side near the key main body section 31, the amount that the position of the key main body section 31 is changed becomes large and the operation of pressing the key is not stable. Therefore, it is preferable that the connecting section 32 bends and deforms in a portion near the side where the connecting section 32 is connected to the supporting section 11, away from the key main body section 31 as much as possible.

The thickness of the connecting section 32 is thicker at the side near the key main body section 31 than the side near the supporting section 11. With this, the connecting section 32 of the plurality of key main body sections 31 can be bent and deformed at the side near the supporting section 11. With this, the connecting section 32 bends and deforms at a position where the amount that the position of the key main body section 31 is changed can be made comparatively small. Therefore, the operation of pressing the key becomes stable and the variation in the position of the virtual rotating center of the key main body section 31 in the depth direction in response to pressing the key can be reduced.

As described above, the width of the connecting section 32 on the side of the supporting section 11 is wider than the width of the key main body section 31. Therefore, the strength against the twist of the key main body section 31 in the horizontal direction can be increased, but the width of the connecting section 32 on the side of the key main body section 31 cannot be made wider than the width of the key main body section 31. The strength against twist of the key main body section 31 in the horizontal direction can be increased by making the size in the thickness direction larger in the key main body section 31 side of the connecting section 32.

FIG. 5A is a diagram showing a side view of the key unit 1. Three key blocks 10 (10*a*, 10*b*, 10*c*) are positioned to overlap the supporting sections 11 (11*a*, 11*b*, 11*c*) of each of the above in the thickness direction which is the pressing/releasing direction of the key main body section 31. The supporting sections 11 (11*a*, 11*b*, 11*c*) are fixed by a screw 12 and are formed as one.

According to FIG. 5A, the default state in which outer force is not applied to the key 3 is shown with a solid line, and the state showing the key 3 pressed according to operation by the performer (user) is shown with a long dash two short dash line.

Actually, the tip of the key 3 in the default state of the keyboard instrument 100 is usually tilted slightly upward. To simplify description, the default state is shown horizontal.

FIG. 5B is a diagram showing a side view of a main section enlarging the surroundings of the connecting section 32 shown in FIG. 5A.

As shown in FIG. 5A and FIG. 5B, when the key is pressed, the connecting section 32 bends downward with the change of position (rotation) of the key main body section 31. The degree of bend of the connecting section 32 becomes larger in a position closer to the side of the key main body section 31.

According to the present embodiment, in order to reduce the variation in the position of the rotating center (virtual rotating center) of the key main body section 3 in the height direction in response to pressing each of the plurality of key main body sections 31 and to make the operating feel for each key 3 the same, the size of the connecting section 32 in the thickness direction on the side of the supporting section 11 is made as small as possible, and the interval is made as small as possible when the plurality of key blocks 10 (10*a*, 10*b*, 10*c*) are positioned layered in the thickness direction so that the supporting sections 11 (11*a*, 11*b*, 11*c*) are overlapped.

Here, when the connecting section 32 is extended from the supporting section 11 side to the key main body section 31 side so as to be horizontal with respect to the top surface of the key main body section 31, in order to achieve height of the key main body section 31 in the plurality of key blocks 10, the position where the connecting section 32 is provided needs to be different in the plurality of key blocks 10 in the thickness direction of the key main body section 31. According to the present embodiment, basically, the connecting section 32 of the key block 10 in which the supporting section 11 is overlapped toward the upper side is provided toward the upper side in the thickness direction of the key main body section 31 than the connecting section 32 of the key block 10 in which the supporting section 11 is overlapped toward the lower side. The difference of the position where the connecting section 32 is provided is made the same as the interval that the supporting section 11 is overlapped.

However, since the width of the connecting section 32 on the side of the supporting section 11 is made wider than the width of the key main body section 31, when the key 3 of the key block 10*a* provided at the top is pressed and the connecting section 32 bends toward the bottom, the connecting section 32 of the keys 3 (keys 3*b*, 3*c*) of the key block 10 (10*b*, 10*c*) provided below may interfere with each other.

As for the side of the supporting section 11 in the connecting section 32, the amount of bending is comparatively small so there is no problem. However, as for the side of the key main body section 31 in the connecting section 32, the amount of bending is comparatively large. Moreover, the size in the thickness direction is larger than the side of the supporting section 11. Therefore, in order to prevent interference, the interval when the plurality of key main body sections 31 are positioned layering the supporting section 11 needs to be large.

According to the present embodiment, the difference of the position in which the connecting section 32 is provided in the plurality of key blocks 10 in the thickness direction of the key main body section 31 is larger than the interval of overlapping the supporting section 11.

That is, the connecting section 32 is extended from the supporting section 11 side to the key main body section 31 side and horizontal with respect to the top surface of the key main body section 31. The size of the connecting section 32 in the thickness direction is set to be large in the position near the portion connecting with the key main body 31. The extending direction is bent up or down from a horizontal state and then the connection with the key main body section 31 is made.

For example, the connecting section 32*b* of the white key and the connecting section 32*a* of the white key have a characteristic shape so that the connecting section 32*b* and the connecting section 32*a* do not hit the connecting section 32*c* of the black key when the connecting section 32*b* and the connecting section 32*a* of the white key positioned to the upper side than the position where the connecting section 32*c* of the black key is positioned are bent.

That is, the direction that the connecting section 32 bends in the position near the portion connected to the key main body section 31 in each of the key block 10 is made different so that the interval is wider between the lower side of the connecting section 32 of the key block 10 in which the supporting section 11 is overlapped to the upper side and the upper side of the connecting section 32 of the key block 10 in which the supporting section 11 is overlapped to the lower side in the position near the portion where the connecting section 32 is connected to the key main body section 31.

Figure 6A:
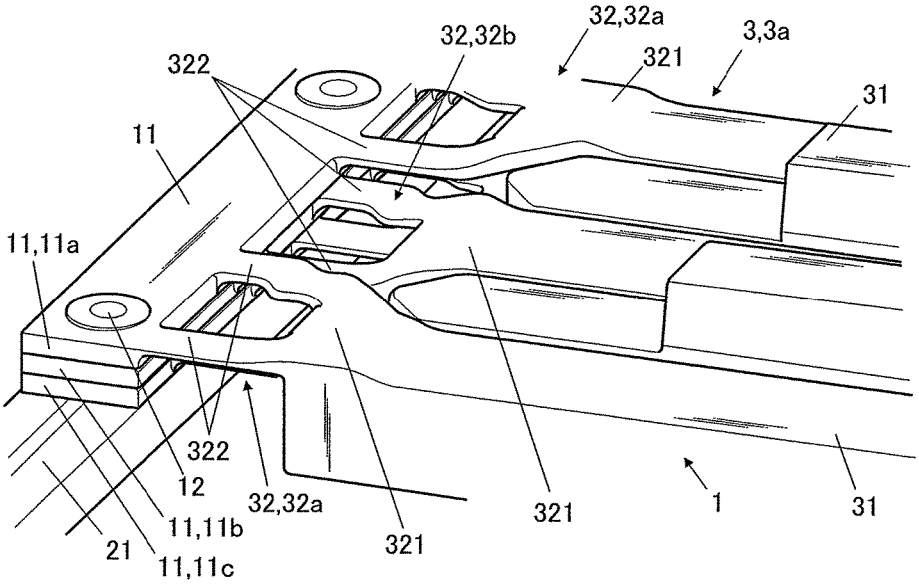
FIG. 6A is a diagram showing a perspective view of a main section enlarging the surroundings of the connecting section when the projection is provided in the connecting section.
Figure 6B:
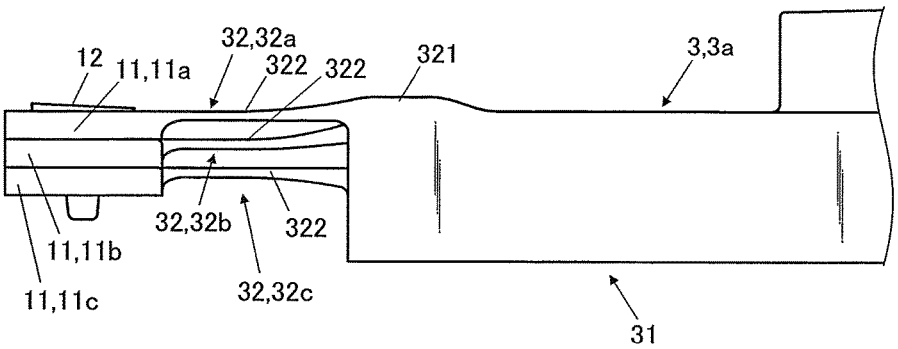
FIG. 6B is a diagram showing a side view of the key section shown in FIG. 6A.

Further, as shown in FIG. 6A and FIG. 6B, at least one portion of the connecting section 32 of the key block 10 in which the supporting section 11 is overlapped to the upper side is projected to the upper side in the thickness direction than the linking portion with the supporting section 11, and this is to be the projection 321 positioned in a position higher than the top surface of the key main body section 31.

By providing the projecting section 321 in the connecting section 32, there is a clearance between the components positioned below the connecting section 32 in the amount that the connecting section 32 is raised. With this, the possibility of interference with the keys 3 (keys 3*a*, 3*b*) of the key block 10 (10*b*, 10*c*) positioned second and third can be avoided.

Among the key blocks 10 (10*a*, 10*b*, 10*c*) of the key unit 1, the bend of the connecting section 32 connected to the supporting section 11 (11*a*) positioned to the uppermost side in the thickness direction has the highest possibility of interfering with the sections of the keys 3 of the key block 10 positioned below. Therefore, preferably, at least a portion of the connecting section 32 connected with the supporting section 11 (11*a*) positioned at the uppermost side in the thickness direction is provided with the projection 321.

Figure 7:
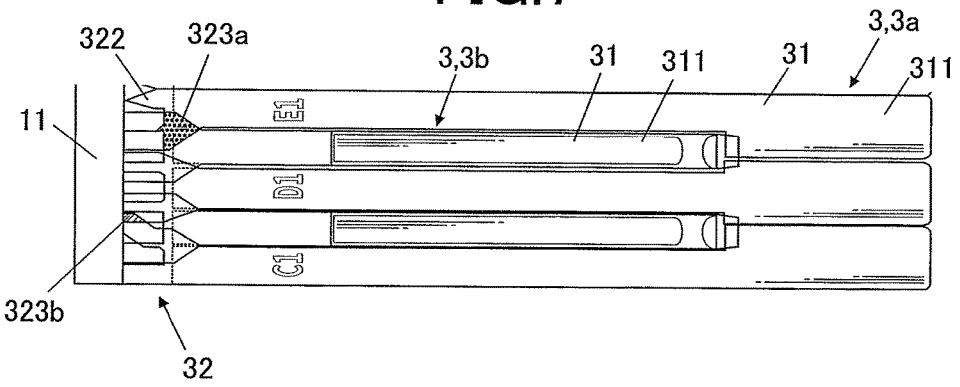
FIG. 7 is a diagram showing a planar view showing a portion where overlap of the key unit occurs according to the present embodiment.

FIG. 7 shows an enlarged diagram of a portion of the planar view of the key unit shown in the right side of FIG. 3.

In FIG. 7, the region in which the bend of the connecting section 32 may interfere with the sections of the key 3 of the connecting section 32 in the key block 10 positioned below is shown as interference regions 323*a*, 323*b*.

The interference regions 323*a*, 323*b* are not the entire range where the connecting section 32 is positioned, and are limited regions as shown in FIG. 7.

That is, for example, as shown in the illustrated examples, the possibility of interference between the E1 key and the adjacent black key (D# key) is the interference region 323*a*, and the possibility of interference between the C1 key and the D1 key is the interference region 323*b*.

The portion where the connecting section 32 of the C1 key may overlap with that of the adjacent C# key is the key 3 (3*a*) which is the first from the top and the key (3*c*) which is the first from the bottom. Since there is a large clearance between the above, the problem of interference does not occur in the present configuration. Therefore, according to the configuration shown in FIG. 7, the projection 321 to avoid interference is to be provided in at least the portions shown in interference regions 323*a*, 323*b*. For example, the projection 321 does not have to be provided in all of the connecting sections 32 provided in the key block 10*a* positioned in the thickness direction.

As described above, specifically, whether to provide a projection 321 in the connecting section 32 with a shape and range as described above is a matter of design, and can be suitably determined according to the configuration and the shape of the key blocks 10 (10*a*, 10*b*, 10*c*) included in the key unit 1, and the shape and configuration of the connecting section 32.

Figure 8A:
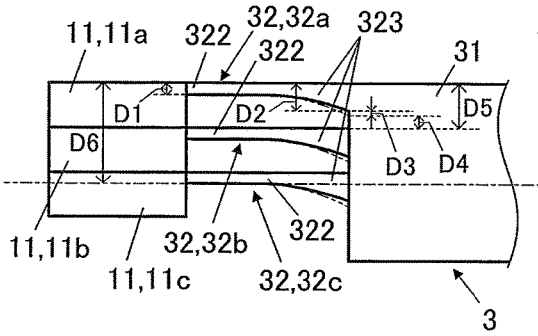
FIG. 8A is a descriptive diagram showing a size of each section when the projection is not provided in the connecting section.
Figure 8B:
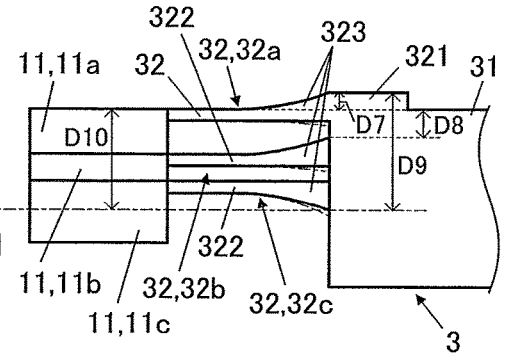
FIG. 8B is a descriptive diagram showing a size of each section when the projection is provided in the connecting section.

Next, with reference to FIG. 8B and FIG. 8A, the effect of the key unit 1 according to the present embodiment and the keyboard instrument 100 including such key unit 1 is described.

FIG. 8B is a diagram showing a side view of the key unit when the connecting section is provided on the top surface side of the key main body section and a projection is provided in the connecting section. FIG. 8A is a diagram showing a side view of the key unit when the connecting section is provided on the top surface side of the key main body section.

In both FIG. 8B and FIG. 8A, by providing the connecting section 32 on the top surface side of the key main body section 31, the key main body section 31 can be supported from the upper surface side and the lower surface side by the key guide section 22 on the keyboard chassis 2 side and the connecting section 32. Therefore, it is possible to prevent twists and distortions of the key 3 in the width direction and the key 3 can be pressed stably.

According to the present embodiment, the projection 321 is provided in the connecting section 32 as shown in FIG. 8B. With this, a further excellent effect can be achieved compared to the example shown in FIG. 8A which is not provided with a projection 321.

FIG. 8B and FIG. 8A are described by presenting examples of values of each section.

First, the distance (difference in height) between the connecting section 32 (32*a*) connected to the supporting section 11 (11*a*) positioned in the uppermost side in the thickness direction and the connecting section 32 (32*c*) connected to the supporting section 11 (11*c*) positioned in the lowermost side in the thickness direction is described in the example provided with the projection 321 and the example not provided with the projection 321.

Here, in the illustrated example, the thickness of the connecting portion with the supporting section 11 in the connecting section 32 is to be D1=1.0 mm, and the thickness of the connecting portion with the key main body portion 31 in the connecting section 32 is to be D2=2.5 mm.

The lowering amount D3 of the connecting section 32 by the bend of the key 3 (3*a*) when the key is pressed is 0.5 mm in the connecting portion with the key main body section 31. In this case, in a simulation assuming that the clearance D4 between the connecting section 32 (32*b*) of the key 3 (3*b*) adjacent in the vertical direction is 1.0 mm, the measurements below can be obtained.

In FIG. 8B and FIG. 8A, the position of the connecting section 32 before pressing the key is shown with the solid line, and the position of the connecting section 32 when bent by pressing the key is shown with the long dash two short dash line.

As shown in FIG. 8A, when the connecting section 32 is almost the same height as the connecting portion with the supporting section 11, and is also almost the same height as the top surface of the key main body section 31, if the connecting section 32 (first connecting section 32*a*) connected to the supporting section 11 (11*a*) positioned in the uppermost side in the thickness direction is set as follows, "thickness D2=2.5 mm" "assumed lowering amount D3 by bending=0.5 mm"+"clearance D4=1.0 mm", then D5=4.0 mm, and the position lowered 4.0 mm from the top surface of the key main body section 31 is to be the upper surface of the connecting section 32 (32*b*) of the second key block 10 (10*b*).

Similarly, the position lowered 4.0 mm from the upper surface of the connecting section 32 (32*b*) is to be the upper surface of the connecting section 32 (32*c*) of the third key block 10 (10*c*). Then, the thickness of the third connecting section 32 (32*c*) is 1.0 mm similar to the first connecting section 32*a*, the height D6 occupied by the three connecting sections 32 (32*a*, 32*b*, 32*c*) is 9.0 mm.

When it is assumed that the center ("virtual center" or "virtual rotating center") of the rotation (rotation to the key pressing direction when the key is pressed) of the key 3 by the connecting section 32 is in the center portion in the thickness direction of the connecting section 32, the virtual center of rotation of the first key 3 is separated from the virtual center of the third key 3 by 8.0 mm.

Actually, when the connecting section 32 in the hinge shape according to the present embodiment bends and deforms to rotate the key 3 in the key pressing/releasing direction, the rotating center is not in a specific position, and the rotating center slightly changes as the angle of pressing the key changes. Therefore, the rotating center here is a virtual point.

In view of the above, as shown in FIG. 8B, when the projection 321 is provided in the connecting section 32 projecting upward in the thickness direction than the linking portion of the supporting section 11 and is positioned in a higher position than the top surface of the key main body section 31, the measurements are as described below. In the example shown in FIG. 8B, similar to the example shown in FIG. 8A, the hinge thickness D1=1.0 mm.

For example, the upper surface of the connecting section 32 (32*a*) is moved (projected) in the upper direction 1.5 mm than the top surface of the key main body section 31 (31*a*) (D7=1.5 mm) and this is to be the projection 321.

As shown in FIG. 8B, if the connecting section 32 (first connecting section 32*a*) connected to the supporting section 11 (11*a*) positioned in the uppermost side in the thickness direction is set as follows, "D7+D8=thickness of connecting section 32*a*=2.5 mm"+"assumed lowering amount by the bend=0.5 mm"+"clearance D4=1.0 mm", since the position of the start when the connecting section 32*a* is lowered is in a position 1.5 mm higher, "4.0 mm−1.5 mm=2.5 mm", and the connecting section 32*a* is only lowered in the amount of the above difference 2.5 mm.

Therefore, the upper surface of the connecting section 32 (32*b*) of the second key block 10 (10*b*) is positioned 2.5 mm lower from the upper surface of the first connecting section 32*a*. Since the projection 321 is provided in the upper surface of the first connecting section 32*a* and the height is 1.5 mm higher, the space of the connecting section 32 overlapping vertically can be made smaller.

With this, the height (thickness) from the upper surface of the projection 321 of the first connecting section 32*a* to the lower surface of the lowest and third connecting section 32 (32*c*) is 9.0 mm similar to FIG. 8A (D9=9.0 mm), and the height (thickness) from the upper surface of the first connecting section 32*a* to the lower surface of the lowest and third connecting section 32 (32*c*) is to be a thickness of 7.5 mm (D10=7.5 mm).

Then, when the virtual center is set similar to FIG. 8A, the virtual center of rotation of the first key 3 is separated 6.5 mm from the virtual center of the third key 3. By comparing the position of the virtual center, compared to when the projection 321 is not provided, the distance from the first key block 10 (10*a*) to the third key block 10 (10*c*) can be made closer by 1.5 mm.

As described above, by providing the projection 321, the key blocks 10 (10*a* to 10*c*) can be made closer, and the key unit 1 can be made more compact.

That is, in the plurality of connecting sections 32 including the plurality of key blocks 10, the thickness of the portion 323 in the vertical direction where the connecting section 32 is linked with the key main body section 31 is thicker than the thickness of the portion 322 in the vertical direction where the connecting section 32 is linked with the supporting section 11.

In the connecting section 32 in the key block 10 with the supporting section 11 among the plurality of supporting sections 11 of each plurality of key blocks 10 positioned in the uppermost side in the vertical direction, the linking section 323 (projection 321) between the connecting section 32 and the key main body 31 is projected upward so that the top surface of the portion where the connecting section 32 is linked to the key main body 31 is higher than the top surface of the portion where the connecting section 32 is linked to the supporting section 11.

Figure 9:
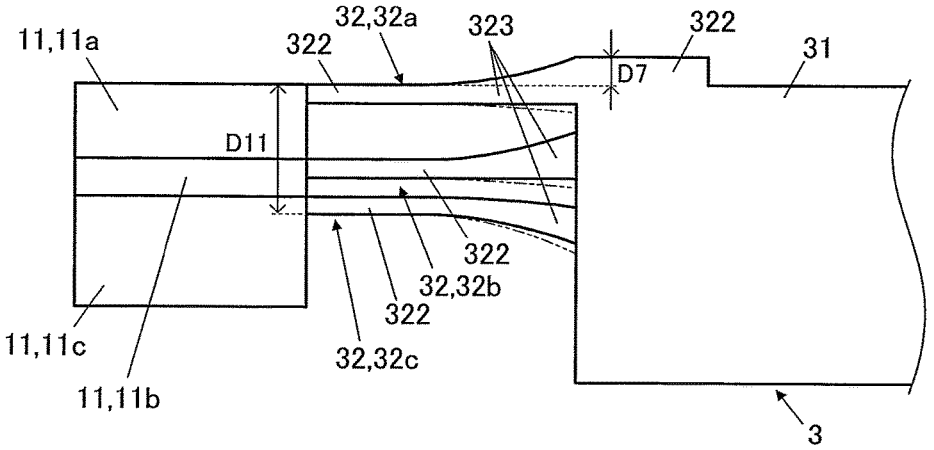
FIG. 9 is a descriptive diagram showing a size of each section in a modification when the projection is provided in the connecting section.

The thickness of at least one of the supporting sections 11 in the vertical direction among the plurality of supporting sections 11 of the plurality of key blocks 10 is thinner than the thickness of the other supporting sections in the vertical direction. That is, as shown in FIG. 8B and FIG. 9, comparing the thickness of the supporting section 11*a*, the supporting section 11*c*, and the supporting section 11*d*, the thickness of the supporting section 11*b* is thinner than the supporting section 11*a* and the supporting section 11*c*.

The linking section 323 is curved upward between the plurality of connecting sections 32 and the key main body 31 included in the plurality of key blocks 10 with the plurality of supporting sections 11 of the plurality of key blocks 10 positioned in the upper side in the vertical direction.

The plurality of key blocks 10 include a black key block 10*c*, and a plurality of white key blocks 10*a* and 10*b*, and the supporting sections 11*a* and 11*b* of the plurality of white key blocks are positioned in the instrument case overlapped on the upper side of the supporting section 11*c* of the black key block.

With this, the top surface in the connecting section 32*a* in the key block 10*a* with the uppermost positioned supporting section 11 in the vertical direction among the plurality of supporting sections 11 of the plurality of key blocks 10 is provided in a position with the same height as the top surface of the key main body 31 or in a position higher than the top surface of the key main body 31.

As described above, according to the present embodiment, a key block 10 includes a connecting section 32 which is provided on the top surface side of the key main body section 31 which is the other end side in the longitudinal direction of a plurality of key main body sections 31 including an action section 311 in one end side in the longitudinal direction and which is able to bend and deform along a pressing/releasing direction of the key main body section 31 and a supporting section 11 which supports the plurality of key main body sections 31 through the connecting section 32 so as to be swingable along the pressing/releasing direction, and the key block is positioned so that the supporting section 11 overlaps on one another in the thickness direction which is the pressing/releasing direction of the key main body section 31. With this, the key unit 1 is formed.

By providing the connecting section 32 on the top surface side of the key main body section 31, the key main body section 31 is supported from the upper surface side and the lower surface side by the key guide section 22 of the keyboard chassis 2 side and the connecting section 32. Therefore, when the key is pressed, the twist and distortion hardly occurs in the width direction of the key 3, and stable operation of pressing the key can be achieved.

According to the present embodiment, at least some of the connecting sections 32 project upward in the thickness direction than the linking portion with the supporting section 11 and this is to be a projection 321 positioned in a position higher than the top surface of the key main body section 31.

As described above, by providing the projection 321 in the connecting section 32, a clearance in the height direction can be obtained for the connecting section 32 which is the portion which bends and deforms. With this, the key unit 1 can be assembled in a compact form to make the key unit 1 smaller, and this can prevent interference with other keys 3.

Since the clearance in the height direction can be obtained, the distance between the connecting sections 32 of the keys 3 of the key blocks 10 (10*a*, 10*b*, 10*c*) overlapped in the thickness direction can be made close without causing interference among each other. Therefore, the distance of the rotating centers (rotation center) (virtual point) of the keys 3 of the key blocks 10 (10*a*, 10*b*, 10*c*) can also be made close in the height direction. Therefore, the variation of the rotating centers of the keys 3 in the height direction can be prevented, and the strange feeling due to the variation of the rotating center of the key 3 in the height direction can be prevented. With this, the performer (user) can perform a smoother performance.

According to the present embodiment, at least some among the connecting sections 32 (32*a*) connected to the supporting section 11 (11*a*) positioned to the uppermost side in the thickness direction is provided with a projection 321.

As described above, the projection 321 is provided in the connecting section 32 positioned in the uppermost side of the connecting section 32 which may cause problems such as interference with the key 3 included in the key block 10 in the lower position. Therefore, a compact configuration can be realized more effectively in the thickness direction.

According to the present embodiment, the size of the connecting section 32 in the width direction is formed larger than the size of the key main body section 31 in the width direction.

As described above, the size of the connecting section 32 in the width direction is made large in the width direction so that the key main body section 31 can be linked to the supporting section 11 more stably and it is possible to prevent twisting and distorting of the key 3 when the key is pressed. With this, even when the key main body section 31 is supported by the thin plate shaped connecting section 32, stable operation of pressing the key without a strange feeling to the performer (user) can be obtained.

According to the present embodiment, the connecting section 32 is formed so that the thickness on the key main body section 31 side is thicker than the thickness on the supporting section 11 side.

When the key is pressed, as the connecting section 32 bends closer to the key main body section 31, the change of position becomes larger, and the possibility of interference with the other keys 3 positioned in the surroundings increases.

When the thickness of the key main body section 31 side is thicker than the thickness on the supporting section 11 side, the side closer to the key main body section 31 hardly bends, and the connecting section 32 bends in the position closer to the linking portion with the supporting section 11 as much as possible. With this, the amount of change of position can be reduced.

By providing a key unit 1 as described above, and a keyboard chassis 2 with the key unit 1 attached in the keyboard instrument 100, the interference among the keys 3 can be prevented and the smooth performance is possible. Moreover, the components stored in the keyboard instrument 100 can be made as small as possible.

According to the present embodiment, the present invention is not limited to the above embodiments, and various modifications are possible without leaving the scope of the present invention.

For example, according to the present embodiment, the projection 321 is provided in the connecting section of the key 3 in all key blocks 10 composing the key unit 1. Alternatively, the projection 321 may be provided in only the connecting section 32 provided in the key of the first key block 10*a* in which the supporting section is positioned in the uppermost position.

The shape and the degree of projection of the projection 321 are not limited and the projection 321 may be projected further upward.

The key 3 may be in a form folded to form a mountain in the connecting section 32 so that the supporting section 11 is positioned in a position lower than the height of the connecting section 32 and the top surface of the key main body section 31.

For example, in addition to the configuration of the above-described embodiment, opposite to the connecting section 32 (32*a*) of the key block 10 (10*a*) positioned in the uppermost position, in the connecting section 32 (32*c*) of the key block 10 positioned in the lowermost position, the height of the upper surface of the connecting portion with the key main body section 31 of the connecting section 32 can be lower than the connecting portion with the supporting section 11 in the connecting section 32.

In this case, in the amount that the height of the upper surface of the connecting section 32 is lowered, a clearance to prevent interference with the connecting section (32*a*, 32*b*) positioned above can be obtained, and the effect to avoid interference effectively can be obtained.

According to the present embodiment, in the key unit 1 linking the supporting section 11 and the key main body section 31 with the hinge shaped connecting section 32, the rotating operation of the key 3 is slightly different depending on the height of the rotating center of the key 3 when the key is pressed (as described above, the rotating center is a virtual point and slightly moves with the position of the pressed key). Such variation causes a strange feeling to the performer (user) during the performance.

According to the above configuration, the shift in the position of the virtual rotating center in the height direction in the keys 3 of the first to third key blocks 10 becomes small, and the strange feeling to the performer due to the variation of the rotating center in the height direction can be greatly reduced.

According to the configuration of the above-described embodiment, the third key block 10 (10*c*) is a block with a black key 3*b*. The operating position when the key is pressed is different from the white key 3*a*. Therefore, the strange feeling felt by the performer hardly occurs. Therefore, according to the configuration of the present embodiment, it is most important to make the shift in the position of the virtual rotating center in the height direction (difference in height direction) as small as possible among the white keys 3*a* of the first and the third key blocks 10*a*, 10*c*.

According to the position of the key block 10, when the key unit 1 is combined by overlapping the following in the order from the top, first the key block 10 of the white key 3*a*, second the key block 10 of the black key 3*b*, third the key block 10 of the white key 3*a*, or when the key unit 1 is combined by overlapping the following in the order from the top, first the key block 10 of the black key 3*b*, second the key block 10 of the white key 3*a*, and third the key block 10 of the white key 3*a*, in addition to the above-described configuration, it is important that the height of the rotating center of the key 3 included in the third key block 10 is not separated from the rotating center of the other key 3 as much as possible.

FIG. 9 shows in the key 3 of the third key block, which is the lowest, the height of the connecting section 32 of the linking portion with the supporting section 11 is moved in the upper direction 0.5 mm higher than the height of the connecting section 32 in the connecting portion with the key main body section 31.

In the example shown in FIG. 9, the distance D11 from the upper surface (highest surface) of the connecting section 32 of the key 3 of the first key block 10 which is highest to the lower surface (lowest surface) of the connecting section 32 of the key 3 of the third key block 10 which is lowest is 7.0 mm. Compared to the example shown in FIG. 8B, the height in the thickness direction is reduced by 0.5 mm.

In this case, when the virtual center is set, the distance from the virtual center of rotation of the first key 3 to the virtual center of the third key 3 is 6.0 mm. Comparing the position of the virtual center, the distance from the first key block 10 (10*a*) to the third key block 10 (10*c*) can be made closer by 1.5 mm compared to the example shown in FIG. 8B.

Specific embodiments of the present invention were described above, but the present invention is not limited to the above embodiments, and modifications, improvements, and the like within the scope of the aims of the present invention are included in the present invention. It will be apparent to those skilled in the art that various modifications and variations can be made in the present invention without departing from the spirit or scope of the invention. Thus, it is intended that the present invention cover modifications and variations that come within the scope of the appended claims and their equivalents. In particular, it is explicitly contemplated that any part or whole of any two or more of the embodiments and their modifications described above can be combined and regarded within the scope of the present invention.

What is claimed is:

1. A keyboard instrument comprising:

a plurality of key blocks, each key block including:

a plurality of key main bodies, each key main body having a top surface, and an area of the top surface abutting a first edge side of the key main body in a longitudinal direction being pressable by a user;

a plurality of connecting sections, respectively corresponding to the plurality of key main bodies, each connecting section being provided on a top surface side abutting a second edge side of the key main body in the longitudinal direction, and the connecting section being deformed in response to its respective key main body being pressed by the user; and a supporting section which supports the plurality of key main bodies as one key block through the plurality of connecting sections; and an instrument case which houses the plurality of key blocks, wherein the supporting sections included in the plurality of key blocks are piled up in a direction intersecting with the longitudinal direction in the instrument case, and wherein the plurality of connecting sections included in one key block and the plurality of connecting sections included in another key block overlap each other in the instrument case.

2. The keyboard instrument according to claim 1, wherein, in the direction intersecting with the longitudinal direction in each of the plurality of connecting sections, a connecting portion between the connecting section and one of the key main bodies is thicker than a connecting portion between the connecting section and the supporting section.

3. The keyboard instrument according to claim 1, wherein, in at least one connecting section in the key block in which the supporting section among the plurality of supporting sections of the plurality of key blocks is positioned in an uppermost position, a top surface of the connecting portion between the connecting section and the key main body is higher than a top surface of the connecting portion between the connecting section and the supporting section.

4. The keyboard instrument according to claim 1, wherein, a thickness of at least one of the supporting sections in a vertical direction is thinner than a thickness of another one of the supporting sections in the vertical direction among the plurality of supporting sections of the plurality of key blocks.

5. The keyboard instrument according to claim 1, further comprising upwardly curved linking sections which are linked with the key main body in the plurality of connecting sections included in the plurality of key blocks in which the supporting sections of the plurality of key blocks are positioned on an upper side in a vertical direction.

6. The keyboard instrument according to claim 1, wherein:

the plurality of key blocks include a key block for black keys and a plurality of plural key blocks for white keys, and the supporting section of the plural key blocks for white keys are overlapped above the supporting section of the key block for black keys in the instrument case.

7. The keyboard instrument according to claim 6, wherein, a position of a top surface in one of the plurality of connecting sections in the key block with the supporting section among the supporting sections of the plurality of key blocks positioned in an uppermost position in a vertical direction, is provided at a same height as a top surface of the plurality of key main bodies or at a position higher than the top surface of the plurality of key main bodies.

* * * * *